US005400444A

United States Patent [19]

Boyer et al.

[11] Patent Number: 5,400,444

[45] Date of Patent: Mar. 28, 1995

[54] DOUBLE FLUSH TOILET VALVE

[76] Inventors: Jacques E. Boyer, 68 Huntington Cir., Pittsburg, Calif. 94565; Pierre J. Boyer, 3360 Monterey Blvd., Oakland, Calif. 94602

[21] Appl. No.: 949,037

[22] Filed: Sep. 21, 1992

Related U.S. Application Data

[63] Continuation-in-part of Ser. No. 743,852, Aug. 12, 1991, Pat. No. 5,157,796.

[51] Int. Cl.[6] ..... E03D 1/14; E03D 1/35

[52] U.S. Cl. ..... 4/325; 4/394; 4/404

[58] Field of Search ..... 4/324, 325, 392, 393, 4/394, 403, 404, 415

[56] References Cited

U.S. PATENT DOCUMENTS

| | | | |
|---|---|---|---|
| 3,935,598 | 2/1976 | Schmidt | 4/393 |
| 3,969,775 | 7/1976 | Haselton | 4/393 X |
| 4,000,526 | 1/1977 | Biela et al. | 4/393 X |
| 4,160,294 | 7/1979 | Crumby | 4/393 X |
| 4,497,076 | 2/1985 | Sullivan | 4/392 |
| 4,953,237 | 9/1990 | Perkins | 4/324 |
| 5,157,796 | 10/1992 | Boyer et al. | 4/394 |
| 5,181,282 | 1/1993 | Comparetti | 4/404 |

*Primary Examiner*—Charles E. Phillips
*Attorney, Agent, or Firm*—Bruce & McCoy

[57] ABSTRACT

A double flush toilet valve apparatus for permitting full and partial flushes of a toilet water tank by providing a vent hole in the toilet flush valve float which can be opened by an extended additional force actuation of the toilet flush handle to permit flooding of the float valve and premature closing of the discharge outlet of the toilet tank which is regulated by a float which is attached to the actuation chain of the toilet valve. The vent hole is regulated by a flapper seal and flapper seal actuator disposed within the flush valve float.

4 Claims, 1 Drawing Sheet

DOUBLE FLUSH TOILET VALVE

CROSS-REFERENCE TO RELATED PATENT

The present invention is a continuation-in-part of Ser. No. 07/743,852, filed Aug. 12, 1991, now U.S. Pat. No. 5,157,796, for a Double Flush Toilet Valve, issued Oct. 27, 1992.

BACKGROUND OF THE INVENTION

1. Field of the Invention

The present invention relates to toilet flush valves and, more particularly, to a double flush toilet valve and the method for providing a double flush conversion for a standard toilet. The valve of the present invention is very similar to a standard toilet flush valve except that it has an additional vent hole in the float portion thereof which can be opened when the float valve has been actuated to flush the toilet. This is done by providing an extended additional force pull on the toilet handle to open the vent hole whereby water enters the float portion of the valve and partially floods it causing it to have negative buoyancy and eventually to sink prematurely as compared to a standard valve. However, the partially flooded float valve is prevented from sinking and closing the discharge outlet of the toilet water tank until a partial flush has occurred.

2. Description of the Prior Art

The present invention is a modification to a standard toilet float valve which permits the valve to accomplish a double flush. The standard float valve most commonly used today is a rubber flapper valve which is actuated by a pull chain. When the toilet actuation handle is tripped, the chain lifts the float out of its sealing relation on its seat in the discharge outlet of the toilet tank. The float, due to its buoyancy, remains suspended in the water in the toilet tank until the water level recedes, due to the outrushing water, low enough to allow the float to reseat in the discharge outlet and the water tank to begin to refill.

There have been numerous designs which have modified a standard toilet flush valve to allow a shortened flush, such as U.S. Pat. No. 3,969,775 to Haselton issued Jul. 20, 1976, for a Water Closet Flushing Device. This device uses a separate float for the valve attached to the trip chain which is one of the features utilized by the present invention. However, Haselton does not permit a full volume flush; just a shortened one.

U.S. Pat. No. 4,000,526 to Biela et al., issued Jan. 4, 1977, for a Toilet Flushing Apparatus, permits either a partial or complete flush of a toilet which is the same purpose as the present invention but the design of Biela et al. requires a more complicated and different mechanism than the present invention.

U.S. Pat. No. 4,160,294 to Crumby issued Jul. 10, 1979, for a Two-Stage Flush Mechanism For Toilets, accomplishes the same result as does the present invention, and by a similar actuation means, but it requires a completely different and more expensive mechanism to do so.

The modification of the present invention to a standard toilet float valve, which permits a partial as well as a full flush, is provided by attaching a supplemental float to the flush valve and providing an opening in the lower end of the valve float which permits it to intake water and acquire negative buoyancy before the full discharge of the water tank has occurred. As a result, the valve float tends to sink in the outgoing water when its buoyancy becomes negative, but it is prevented from sinking completely and closing the discharge outlet until at least a portion of the tank is emptied by virtue of the separate additional float attached to the valve.

The referenced prior art does not teach the simplified apparatus of the present invention for providing selective partial or full flushing of a toilet by a standard toilet and its actuation mechanism.

SUMMARY OF THE INVENTION

The present invention is a double flush toilet valve for handle operated toilets that permits a full flush by normal tripping of the toilet handle and a shortened flush by momentary extended extra force operation of the toilet handle. The valve which permits this double flush actuation is essentially identical to a standard flexible rubber flapper valve having a pivot hinge at one end thereof. A free end of the valve is disposed at the opposite end thereof from the pivot hinge. An inverted dome float portion is disposed between the two ends and has the lower end of the float formed to seal the discharge outlet of a toilet water tank. The double flush valve is actuated by a trip chain which has its upper end connected to the toilet handle.

The double flush valve of the related patent includes a vent hole formed in the side of the float portion disposed on the free end side thereof. A flexible sealing ring is disposed inside the float portion of the valve and covers the vent hole. A rigid connector has one end thereof secured to the top of the domed portion of the float at a displaced position disposed closer to the free end of the valve than to the center of the top of the float. It has its other end secured to the sealing ring proximate to the vent hole. A supplemental float is secured to the toilet actuation or trip chain with the lower end of the trip chain being secured to the top of the domed float at an effective distance from the point of securement of said connector to the top of the float whereby normal tripping of the toilet handle causes a single pull on the actuation chain commencing a normal flush of the toilet during which the flush valve pivots on its hinge and rises in the water to a normal extended upward projecting floating position. An extended additional force actuation of the toilet handle causes the actuation of the chain to partially deform the domed float portion of the valve causing the rigid connector to pull the sealing ring away from the vent hole and to allow water to enter the float portion of the valve prematurely. As a result, the float valve acquires negative buoyancy and tends to sink, but the supplemental float attached to the actuation chain prevents the domed float from sealing the toilet tank discharge outlet until a partial flush of the toilet has occurred.

A sealing ring deformation restrictor is provided which is secured to the rigid connector and which limits the extent of deformation of the sealing ring from the vent hole.

The present invention contemplates an improved version of the double flush toilet valve which eliminates the need for an extended additional force actuation of the toilet handle to effect the shortened flush. With the improved version, a shortened flush is effected simply by fully depressing the toilet handle while a full flush is effected by pressing the toilet handle partially down to commence the flushing action and then releasing it.

The differences in the apparatus for the improved version include a flapper seal for the vent hole instead of a flexible sealing ring. The flapper seal has a magnetic lock which holds the seal closed over the vent hole until it is actuated. A flapper seal actuator projects into the interior of the float portion instead of the rigid connector, and a flexible connection is secured between the flapper seal and the projecting end of the flapper seal actuator whereby movement of the projecting end away from the flapper seal actuates the seal to uncover the vent hole.

OBJECTS OF THE INVENTION

It is therefore an important object of the present invention to provide a double flush toilet valve for handle actuated toilets which replaces a standard flush valve and requires no modification of the actuation mechanism.

It is another object of the present invention to provide a double flush toilet valve which can be actuated to permit a full flush by pressing the toilet handle partially down to commence the flushing action and then releasing it, and a shortened flush is effected simply by fully depressing the toilet.

It is a further object of the present invention to provide a simple method of modifying a standard toilet to permit double flush actuation for the toilet by alternate actuation of the handle.

Other objects and advantages of the present invention will become apparent when the apparatus and method of the present invention are considered in conjunction with the accompanying drawings.

DESCRIPTION OF THE PREFERRED EMBODIMENT

Figure 1:
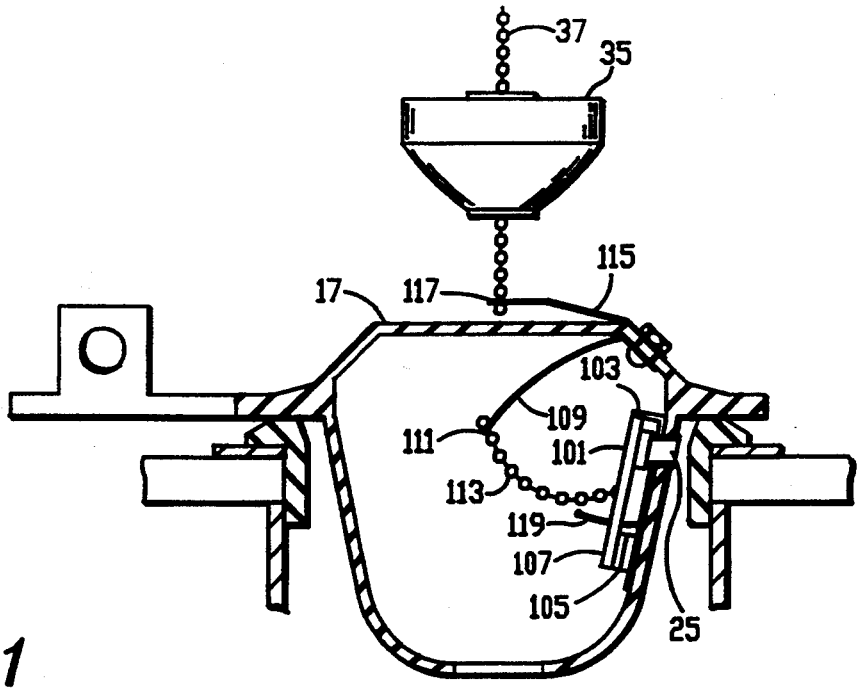
FIG. 1 is side elevation in partial cross-section of the improved double flush toilet valve in seated position in a toilet tank discharge outlet.
Figure 2:
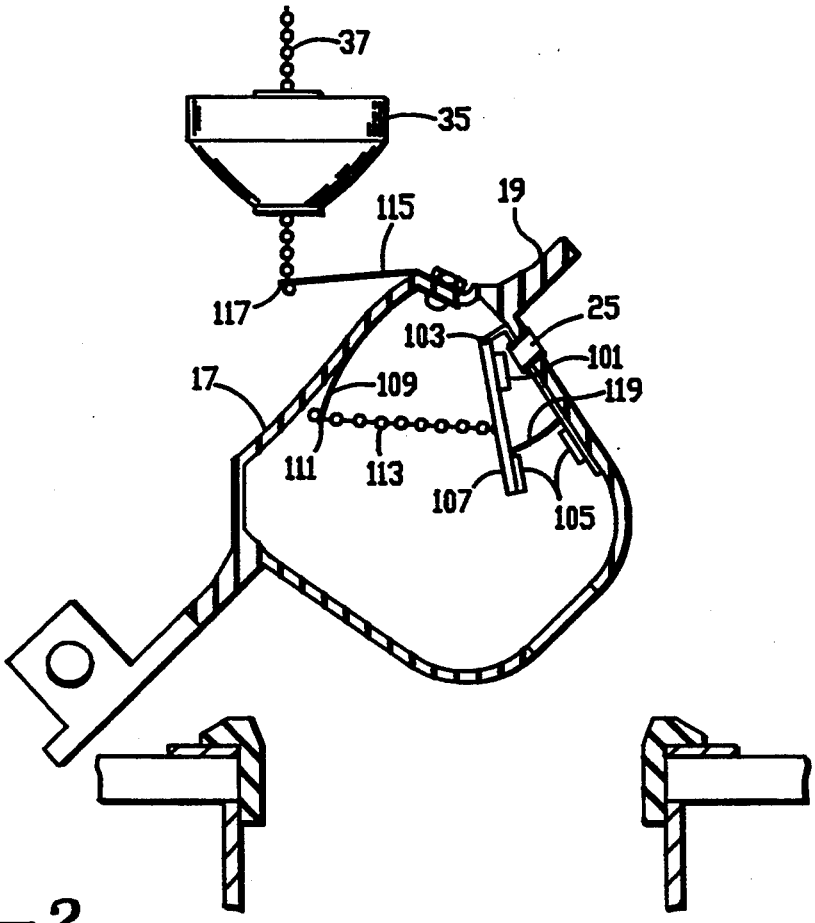
FIG. 2 is the same view as FIG. 1 except that the flush valve is in an upward projecting floating position which occurs when the toilet handle has been fully depressed to open the flapper seal and uncover the vent hole.

Reference is made first to FIGS. 1 and 2 of the above-identified related U.S. Pat. No. 5,157,796 which illustrates an embodiment of a double flush toilet valve 11 for handle operated toilets in the closed position sealing the discharge outlet 13 of a toilet water tank. The water in the tank above the valve is not shown in the drawings. The particular design of the first preferred embodiment of that invention permits a full flush by normal tripping of the toilet handle and a shortened flush by momentary extended extra force operation-of the toilet handle following normal tripping. FIG. 2 shows the flush valve of FIG. 1 when it is in the upward projecting floating position and has been actuated by extra force operation of the toilet handle.

The toilet valve 11 of said invention is essentially identical to a standard flexible rubber flapper toilet flush valve having a flexible pivot hinge 15 at one end thereof which permits the float portion 17 of the valve to rotate up and out of its seat on the water tank discharge outlet 13 when the toilet is flushed. During a flush, while the water is flowing through the discharge outlet in the bottom of the water tank, the flapper valve normally rises in the water and floats in an extended upward projecting position from its attachment to the toilet mechanism at its hinge point as shown in FIG. 2.

The opposite end of the flush valve 11 from the pivot hinge 15 is a free end 19. Disposed between the two ends, the free end and the hinge end 15, is the float portion 17. The float of the flapper valve usually has an inverted dome 21 formed at the lower end thereof for seating in a water tank discharge outlet 13. The top of the float is usually slightly domed also, but it may be flat. The lower end of the float is usually provided with a drain hole 23 to allow water to escape from the float and fall into the discharge outlet of the water tank when the float is seated therein. While some floats are sealed, the float of the said invention requires such a drain hole.

The modified valve 11 of said invention includes a vent hole 25 formed in the side of the float portion 17 of the valve disposed on the free end 19 side thereof. This location for the vent hole orients it on the upper end of the float when it is extended in an upward projecting floating position during the commencement of a flush as shown in FIG. 2 whereby when the vent hole is uncovered, the float quickly floods. When the vent hole allows air to escape and water to enter the float, the float quickly acquires negative buoyancy and tends to sink.

A flexible sealing ring 27 is disposed inside the float portion 17 of the valve 11 and covers the vent hole 25 until it is pulled away from the hole to allow the float to flood. The sealing ring is a wide rubber band which conforms to the inner surface of the float. The sealing ring has sufficient thickness to provide a spring action whereby when it is deformed by retraction to uncover the vent hole, when the retraction force is released, the ring springs outward to reseal the hole.

The sealing ring 27 is actuated to retract by a rigid connector 29 having one end 31 thereof secured to the top of the domed portion of the float 17 at a displaced position disposed closer to the free end 19 of the valve 11 than to the center of the top of the float. The other end 33 of the connector is secured to the sealing ring proximate to the vent hole 25. The rigid connector deforms the sealing ring to retract it from the vent hole as shown in FIG. 2. However, if the sealing ring is pulled too far away from the vent hole, it will collapse inward and lose its ability to reseal the hole. The amount of deformation that the sealing can be subjected to before it will not automatically reseal the vent hole is determined by trial and error and is dependent upon the thickness and hardness of the rubber it is made from and the size of the interior of the float.

A supplemental float 35 is secured to the float portion of said flush valve. In the preferred embodiment, it is secured to the toilet actuation chain 37 with a variable connection which permits the float to be secured at adjustable levels on the chain above the flush valve. This permits adjustment of the volume of the partial flush of the toilet effected by the present invention as will be explained hereinafter. It is believed that a float which is partially conical at the lower end thereof is a preferable configuration in order to prevent it from being trapped or caught on other elements of the toilet mechanisms disposed in the water tank when the water is drained out of the tank during a flush. The allowable space for the float in the toilet tank is quite restricted especially in the vertical direction which is the most crucial orientation. This space consideration is important because the float must be variable along the vertical axis in order to control the length of the shortened flush. The supplemental float attached to the trip chains acts in the same manner as the float of the Haselton '755 patent.

The supplemental float 35 can be held in position on the chain 37 by thin slotted relatively soft plastic disks 39 disposed on opposite sides of the float and which can be adjusted up and down the chain to change the level of the supplemental float on the actuation chain. The thin plastic slotted disks fit between the balls or links on the actuation chain and have been found to be universally adaptable to numerous types of chain because the slot in the soft plastic disks deforms to adapt to the different configurations of chain construction. Other means can be used for attaching the supplemental float to the actuation chain to permit it to be adjustably positioned therealong such as a soft plastic core formed in the float and having a hole therein which the chain passes through and which allows the float to be moved to variable positions on the chain and which grips the chain at any position where it is disposed.

The trip or actuation chain 37 has the upper end connected to the toilet handle. The lower end 43 of the trip chain is secured to the top of the domed float 17 at an "effective distance" from the point of securement of said rigid connector 29 to the top of the float whereby extra force applied to the toilet handle when the float is in the extended upward projecting floating position during a normal flush causes the chain to pull on the top of the domed portion of said float obliquely to deform it. The term "effective distance" means that the actuation chain is secured to the top of the domed float by a means, such as a projecting lever arm 45, which acts on the top of the float at a distance from the point where the lower end of the chain is disposed over the top of the float whereby the extra force pull on the chain deforms the float and actuates the rigid connector to retract the sealing ring away from the vent hole as shown in FIG. 2.

A sealing ring deformation restrictor 57 is provided which is secured to the rigid connector 29 which limits the retraction of the sealing ring 27 from the vent hole 25. This prevents the sealing ring from collapsing inward to a point whereby it cannot spring back and reseal the vent hole when the toilet handle is released and the pull on the trip chain 37 relaxed. The lever arm 45 and the restrictor can be made of corrosion resistant flat spring steel or plastic.

During an extended extra force operation of the toilet handle, the activation of the trip chain 37 pulls on the chain lever arm 45 thereby deforming the top of the float 17, at least to the extent permitted by the restrictor 47, causing the rigid connector 29 to pull the sealing ring 27 away from the vent hole 25 and to allow water to enter the float portion of the valve 11 prematurely before all of the water in the toilet tank has been discharged. As a result, the float valve acquires negative buoyancy and tends to sink except that the supplemental float 35 attached to the actuation chain prevents the float from sinking to seal the discharge outlet 13 until a partial flush has occurred. The higher the height of the supplemental float on the actuation chain, the shorter the flush and vice versa.

In the embodiment of the invention, shown in FIGS. 1 and 2 of the drawings of the Boyer '796 related patent, the restrictor means has the chain lever arm 45 secured to the rigid connector 29 externally of the float portion 17 and extending from the connector toward the hinge end 15 of the float. The chain lower end 43 is secured to the end of the lever arm. A restrictor arm 57 is connected to the rigid connector inside the float portion adjacent to the dome portion of the float. The rigid connector of both embodiments can be made of a threaded shaft which extends through the top of the domed float and is secured thereto by nuts, disposed on opposite sides thereof. The restrictor arm also extends toward the hinged end of the valve like the lever arm and is spaced from the top of the dome portion whereby as the dome portion deflects or deforms during an extended additional force actuation of the toilet handle, the arm rotates upward to contact the dome portion and prevent any further substantial deformation thereof beyond a permissible limit thereby limiting the movement of the rigid connector and the extent of retraction of the sealing ring 29 from the vent hole 25.

There is a problem with certain toilet bowls using a short flush. After two successive flushes, the bowl does not fully evacuate its water as a normal flush always causes it to do. The result is an unwanted dilution of the liquid waste as compared with a full evacuation of the same. This problem is especially undesirable when paper is used. Since most toilets are somewhat different in construction, certain models need a greater volume of water to achieve a full evacuation of the bowl. There are two methods which can be used to increase the volume of water for the short flush. The first is simply to lower the float on the chain so that the flapper closes later in the cycle. This works fine for most applications. However, there comes a point where the float actually interferes with the flapper's action. Also, lowering the float causes a smaller water volume differential between the short and long flush, thereby eliminating the real advantage of a dual action flush mechanism and reducing overall water savings.

It has been determined that by increasing the overall level of water in the tank that the supplemental float can be raised and cause a "longer" shortened flush. This also allows maintaining the needed water volume differential between short and long flush that is desirable. It also increases the overall water pressure in the tank and causes the bowl to fill more rapidly and reduces the amount of water needed for full evacuation. By raising the water line approximately one-half inch in the tank, a volume of water for the long flush remains the same as a result of early closing of the flapper valve due to the heavier float assembly resulting from the construction of the invention. However, raising the water in the tank brings the level close to the top of the overflow tube. Therefore, the overflow tube can be lengthened by an additional short rubber collar which can be inserted over the top of the overflow tube to create a small circular dam which raises the overflow level. In this way, the float valve can be adjusted upwards to effect a later shut off to allow for discharge of the extra one-half or more inch of water in the tank. This arrangement also allows a user to employ water bags or bricks in the water tank to effect water savings for the long flush by displacing water below the short flush water level only.

Reference is made to FIGS. 1 and 2 accompanying this specification for a description of the preferred embodiment of the present invention wherein like reference numbers represent like elements on corresponding views. The improved double flush toilet valve substitutes a flapper portion 107 carrying a seal 101 for the vent hole 25. The flapper portion is secured to the interior surface of the float portion 17 above the vent hole where it is pivoted at 103. A magnetic lock 105 is secured to the lower end of the flapper portion 107. It holds the vent seal 101 closed over the vent hole 25. A flapper portion actuator 109 made of stainless spring steel or a suitable plastic is secured to the top of the dome portion of the float at a displaced position disposed closer to the free end 19 of the valve than to the center of the top of the float. The other or free end 111 of the actuator projects into the interior of the float portion in spaced relation to the walls thereof whereby it can move toward the top of the interior of the float portion. A flexible connector 113 such as a chain or string is secured between the flapper portion and the projecting end of the flapper portion actuator whereby movement of the projecting end away from the flapper portion releases the magnetic lock and moves the seal away from the vent hole. The flapper portion actuator includes a chain lever arm 115 which is connected externally to the flapper portion actuator and has a free end 117 thereof which is connected to the trip chain 37. A motion limiter 119 is provided to prevent excessive opening and premature closing. The limiter in the figures is simply a bent wire with a stop on the end, but it could be built into the hinge of the flapper seal.

Thus it will be apparent from the foregoing description of the present improved invention in its preferred form that it will fulfill all the objects and advantages attributable thereto. While it is illustrated and described in considerable detail herein, the invention is not to be limited to such details as have been set forth except as may be necessitated by the appended claims.

We claim:

1. An improved double flush toilet valve for handle operated toilets that permits a shortened flush by fully depressing the toilet handle before releasing it and a full flush by pressing the toilet handle partially down to begin the flushing action and then releasing it, said valve being essentially identical to a standard flexible rubber flapper toilet flush valve having a pivot hinge at one end thereof, a free end at an opposite end of said valve from said pivot hinge, and a dome float portion disposed between the two ends, said float portion formed to seal the discharge outlet of a toilet water tank, and said double flush valve being actuated by a trip chain having an upper end thereof connected to said toilet handle, said valve comprising:

a vent hole formed in a side of the float portion disposed on the free end side thereof, a flapper portion including a flapper real is disposed inside the float portion of said valve for covering said vent hole, said flapper portion being secured to and pivoted at an upper end thereof to an interior surface of said float portion above said vent hole, said portion having a magnetic lock at a lower end thereof which holds said flapper seal closed over said vent hole, a flapper portion actuator having one end thereof secured to a top of the floated portion at a displaced position disposed closer to the free end of said valve than to the center of the float, portion and another end of said actuator projecting into the interior of said float portion, a flexible connection secured between said flapper portion and the projecting end of said flapper portion actuator whereby movement of said projecting end away from said flapper portion causes said seal to uncover said vent hole, and a supplemental float secured to the float portion of said valve, the lower end of said trip chain being secured to the top of said domed float at an effective distance from the point of securement of said flapper portion actuator to the top of the float portion whereby partial depression of the toilet handle commences the flushing action and causes a normal flush of the toilet during which the flush valve pivots on its hinge and rises in the water to a normal extended upward projecting floating position, and whereby full depression of the toilet handle causes the actuation chain to partially deform the domed float portion of the valve causing the flapper seal actuator to pull the flapper seal away from the vent hole and to allow water to enter the float portion of the valve prematurely whereby the float valve acquires negative buoyancy and tends to sink, but the supplemental float attached to said float portion prevents it from sealing the toilet tank discharge outlet until a partial flush has occurred.

2. The double flush toilet valve of claim 1 wherein the supplemental float is secured to the toilet actuation or trip chain with a variable connection which allows it to be attached thereto at predetermined positions therealong.

3. The double flush toilet valve of claim 1 wherein the flapper seal actuator includes a chain lever arm connected thereto external to said domed float portion, said arm having a free end thereof connected to said trip chain whereby when the toilet handle is fully depressed the float dome deforms to actuate said flapper seal actuator to open said flapper seal.

4. The double flush toilet valve of claim 1 including a restrictor which prevents said flapper seal from excessive opening and premature closure.

* * * * *